US011523238B2

(12) United States Patent
Brockmole

(10) Patent No.: US 11,523,238 B2
(45) Date of Patent: Dec. 6, 2022

(54) DYNAMIC AUDIO UPMIXER PARAMETERS FOR SIMULATING NATURAL SPATIAL VARIATIONS

(71) Applicant: Harman International Industries, Incorporated, Stamford, CT (US)

(72) Inventor: Jeffrey Michael Brockmole, Brighton, MI (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/977,790

(22) PCT Filed: Apr. 2, 2019

(86) PCT No.: PCT/US2019/025359

§ 371 (c)(1),
(2) Date: Sep. 2, 2020

(87) PCT Pub. No.: WO2019/195269

PCT Pub. Date: Oct. 10, 2019

(65) Prior Publication Data

US 2021/0014626 A1 Jan. 14, 2021

Related U.S. Application Data

(60) Provisional application No. 62/652,638, filed on Apr. 4, 2018.

(51) Int. Cl.

| | |
|---|---|
| ***H04S 5/00*** | (2006.01) |
| ***G10L 19/008*** | (2013.01) |
| ***H04S 7/00*** | (2006.01) |

(52) U.S. Cl.
CPC ..... *H04S 5/00* (2013.01); *G10L 19/008* (2013.01); *H04S 7/30* (2013.01)

(58) Field of Classification Search
CPC ..... G10L 19/008; G10L 19/167; G10L 19/22; H04S 2420/01; H04S 7/30
(Continued)

(56) References Cited

U.S. PATENT DOCUMENTS 5,880,392 A 3/1999 Wessel et al.
10,453,434 B1 * 10/2019 Byrd ..... G10L 25/54
(Continued)

FOREIGN PATENT DOCUMENTS

CN 101518103 A 8/2009
EP 1814360 A2 8/2007

OTHER PUBLICATIONS

Wanjun Hou, Computer simulation experiment of step water drop soundscape, issued in Journal of Applied Acoustics, vol. 37, No. 2, Mar. 2018.

*Primary Examiner* — Alexander Krzystan
(74) *Attorney, Agent, or Firm* — Angela M. Brunetti

(57) ABSTRACT

A system and method for creating natural spatial variations in an audio output. At least one parameter in a set of mixer tuning parameters is dynamically modified over time and within a predetermined range that is defined by a set of modification control parameters. The set of mixer tuning parameters that includes the at least one dynamically modified parameter is applied to a mixer allowing the mixer to create natural spatial variations in the audio output to be played at one or more loudspeakers.

18 Claims, 6 Drawing Sheets

(58) Field of Classification Search
USPC ..... 381/307, 17, 22
See application file for complete search history.

(56) References Cited

U.S. PATENT DOCUMENTS

| | | | | |
|---|---|---|---|---|
| 2003/0128825 | A1* | 7/2003 | Loudermilk ..... | H04M 3/4285<br>379/101.01 |
| 2008/0071136 | A1 | 3/2008 | Oohashi et al. | |
| 2011/0081024 | A1 | 4/2011 | Soulodre | |
| 2012/0155650 | A1 | 6/2012 | Horbach | |
| 2012/0207309 | A1* | 8/2012 | Eppolito ..... | H04S 7/40<br>381/17 |
| 2012/0328124 | A1* | 12/2012 | Kjoerling ..... | G10L 19/0204<br>381/98 |
| 2014/0074486 | A1* | 3/2014 | Disch ..... | G10L 19/02<br>704/500 |
| 2016/0026253 | A1* | 1/2016 | Bradski ..... | H04N 13/128<br>345/8 |
| 2016/0249151 | A1* | 8/2016 | Grosche ..... | H04S 3/002 |

* cited by examiner

DYNAMIC AUDIO UPMIXER PARAMETERS FOR SIMULATING NATURAL SPATIAL VARIATIONS

CROSS-REFERENCE TO RELATED APPLICATIONS

The present application claims priority to U.S. provisional patent application Ser. No. 62/652,638 titled Dynamic Audio Upmixer Parameters for Simulating Natural Spatial Variations filed Apr. 4, 2018.

TECHNICAL FIELD

The present disclosure is directed to an audio upmixer algorithm, and more particularly to an upmixer algorithm having dynamic parameters for producing spatial variations over time.

BACKGROUND

Audio upmixer algorithms convert stereo audio into a multi-channel presentation by analyzing characteristics of the audio input such as relative gain, relative phase, relative spectrum versus time, and overall correlation between left and right channels with a goal of creating a strong acoustic soundstage for a listener. This is accomplished using front physical speakers along with side and rear physical speakers to create enveloping ambiance. To optimize signal processing of the audio input, the audio upmixer algorithm uses various tuning parameters to tailor the algorithm to the audio system and to an acoustic space within which it operates, for example, a listening environment such as a vehicle interior, a room, or a theatre. The various tuning parameters are fixed at the time of tuning, resulting in a known and repeatable spatial presentation of the audio.

This fixed and repetitive presentation is not always desirable. For example, an atmospheric or ambient sound, such as an ocean or rainforest soundscape, may be played as a continuous loop of audio. Typically, the continuous loop of audio has a fixed spatial presentation. In such a scenario, the fixed spatial presentation of such an algorithm may end up sounding unnatural or become fatiguing to a listener.

There is a need for a dynamic audio upmixer that simulates natural spatial variations in stereo audio.

SUMMARY

A system for creating natural spatial variations in an audio output. An audio signal processor is configured to dynamically modify at least one parameter in a set of mixer tuning parameters over time and within a predetermined range to transform the audio input signal into an audio output having natural spatial variations in the audio output.

A system and method for creating natural spatial variations in an audio output. At least one parameter in a set of mixer tuning parameters is dynamically modified over time and within a predetermined range that is defined by a set of modification control parameters. The set of mixer tuning parameters that includes the at least one dynamically modified parameter is applied to a mixer allowing the mixer to create natural spatial variations in the audio output to be played at one or more loudspeakers.

The method for creating natural spatial variations in the audio output may also dynamically modify at least one parameter in the set of mixer tuning parameters within a predetermined range for the parameter being modified and based upon a current state of at least one other parameter in the set of mixer tuning parameters.

Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

DETAILED DESCRIPTION

While various aspects of the present disclosure are described with reference to a particular illustrative embodiment, the present disclosure is not limited to such embodiments, and additional modifications, applications, and embodiments may be implemented without departing from the present disclosure. In the figures, like reference numbers will be used to illustrate the same components. Those skilled in the art will recognize that the various components set forth herein may be altered without varying from the scope of the present disclosure.

Any one or more of the servers, receivers, or devices described herein include computer executable instructions that may be compiled or interpreted from computer programs created using a variety of programming languages and/or technologies. In general, a processor (such as a microprocessor) receives instructions, for example from a memory, a computer-readable medium, or the like, and executes the instructions. A processing unit includes a non-transitory computer-readable storage medium capable of executing instructions of a software program. The computer readable storage medium may be, but is not limited to, an electronic storage device, a magnetic storage device, an optical storage device, an electromagnetic storage device, a semi-conductor storage device, or any suitable combination thereof. Any one or more the devices herein may rely on firmware, which may require updates from time to time to ensure compatibility with operating systems, improvements and additional functionality, security updates or the like. Connecting and networking servers, receivers or devices may include, but are not limited to, SATA, Wi-Fi, lightning, Ethernet, UFS, 5G, etc. One or more servers, receivers, or devices may operate using a dedicated operating system, multiple software programs and/or platforms for interfaces such as graphics, audio, wireless networking, enabling applications, integrating hardware of vehicle components, systems, and external devices such as smart phones, tablets, and other systems to name just a few.

Figure 1:
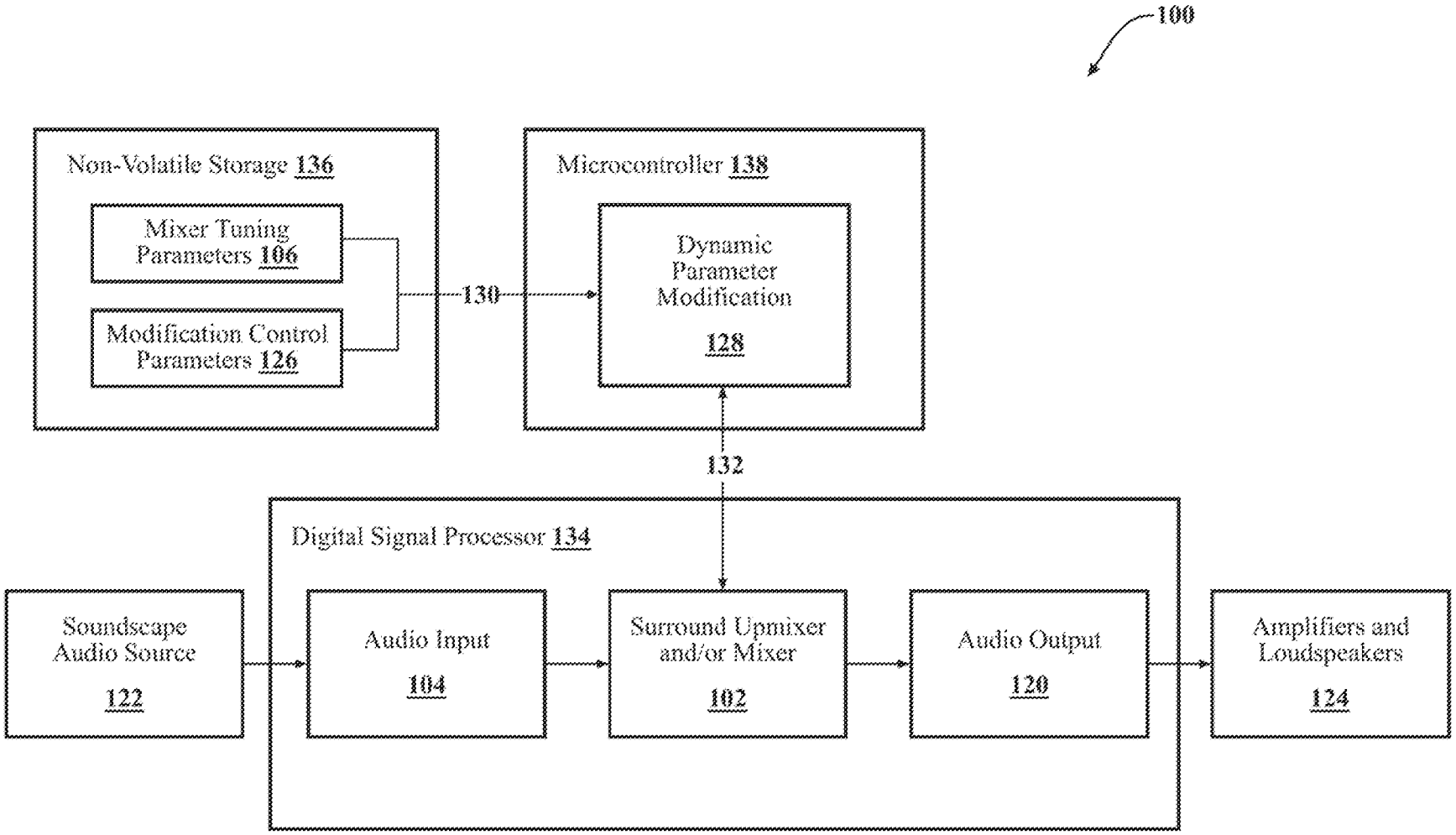
FIG. 1 is a block diagram of an audio processing system.

FIG. 1 is a block diagram of a system 100 for processing an audio input signal 104 with dynamic parameter modification 128 to provide an audio output signal 120 that is to be played at amplifiers and loudspeakers 124 in a venue. Examples of venues for system 100 may include a vehicle audio system, a stationary consumer audio system such as a home theater system, an audio system for a multimedia system such as a movie theater, a multi-room audio system, a public address system such as in a stadium or convention venue, an outdoor audio system, or an audio system in any other venue which it is desired to reproduce audio.

A soundscape audio source 122 provides a digital signal processor (DSP) 134 with the audio input signal 104. Examples of the soundscape audio source 122 may include, but are not limited to, a media player such as a compact disc, video disc, digital versatile disk, BLU-RAY disc player, a video system, a radio, a cassette tape player, a wireless or wireline communication device, a navigation system, a personal computer, a codec such as an MP3 player, a smart phone, a tablet, a wearable device or any other form of audio related device capable of outputting different audio signals on at least two channels. The DSP 134 includes mixer 102, which may be a surround upmixer with optional post-mixing capabilities or it may be a mixer capable of handling two or more channels of audio. The description herein, for example purposes with describe a surround upmixer 102. The description herein will be mainly associated with the surround upmixer 102, the mixer tuning parameters 106, and the soundscape audio input 104. However, it should be noted that a conventional audio input (not shown) may be combined into output channels so that the soundscape audio may be played simultaneously with conventional audio. For example, when a soundscape audio is playing and conventional audio, such as a navigation prompt, is also being played.

Surround upmixer 102 transforms the audio input 104 by applying a set of fixed tuning parameters 106, referred to herein as mixer tuning parameters. Surround upmixer 102 may use known multi-channel surround-sound technology, such as QUANTUMLOGIC® Surround (QLS) by Harman International of Stamford, Conn., to convert an audio input 104 into a multi-channel output.

The audio input signal 104 has at least two channels of audio. In the present disclosure, the audio input signal 104 has been specially recorded as a soundscape audio input to create an immersive environment. The immersive environment may include, but is not limited to, an ocean, a gentle rain storm, or a rainforest, for example.

Mixer tuning parameters 106 are fixed parameters that, when used to process the audio input 104, create static mixes of the audio input 104. The soundscape audio input 104 is usually played in a repetitive loop. When the audio input 104 is played back with fixed mixer tuning parameters 106, the fixed spatial presentation may become fatiguing to a listener and ultimately become unnatural. This problem is addressed in the present disclosure by a set of modification control parameters 126 that set allowable limits for the mixer tuning parameters 106. The mixer tuning parameters 106, are modified by a dynamic parameter modification algorithm 128 within limits defined by the set of modification control parameters 126. The dynamic parameter modification algorithm 128 then provides a set of modified tuning parameters to the surround upmixer 102, where the surround upmixer 102 produces dynamic mixes of the audio input 104 into an audio output 120. The dynamic parameter modification 128 provides the upmixer 102 with the ability to insert natural spatial variations into the audio input 104 thereby avoiding the repetitive loop caused by fixed mixer tuning parameters 106 that would typically be applied on their own.

In an example application, a user may select a soundscape audio input 104 for a natural environment, such as a beach, from the soundscape audio source 122. The audio input 104 is processed, as within a DSP 134, by the upmixer 102, and dynamic parameter modification 128 applies parameter modifications to the upmixer 102 in order to create an intended sound field that has natural spatial variation. This is accomplished by manipulating how the upmixer 102 interprets channels based on tuning parameters being applied to the audio input 104. A basic tuning system, only using fixed mixer tuning parameters 106 directly, would map the intended sound field to realities of the venue, which are defined by acoustics of the venue and types and locations of various loudspeakers in the venue. According to the present disclosure, real-time dynamic parameter modification 128 modifies the mixer tuning parameters 106 during playback of the audio input 104, which changes the spatial presentation of the intended sound field over time. The real time dynamic parameter modification 128 provides a sense of realism to the intended sound field by preventing a repetitive loop. The set of modification control parameters 126 are used to adjust the mixer tuning parameters 106 for the specific application, and the dynamic parameter modification 128 determines and communicates the mixing parameters that are to be used at the surround upmixer 102.

The dynamic parameter modification algorithm 128 may be carried out in several manners. In FIG. 1 it is shown, for example purposes, as residing in a microcontroller 138 having non-volatile storage 136 for the mixer tuning parameters 106 and the modification control parameters 126. The microcontroller 138 may communicate with the DSP 134. The DSP may also communicate processing state information to the dynamic parameter modification algorithm 128. Examples of processing state information may include, but is not limited to, current settings, measurements or detected levels of variables in the audio system such as volume, loudness, EQ, tone, gain, bass management, etc.

The dynamic parameter modification algorithm 128 may, alternatively, be part of the DSP 134 itself, or it may be integrated, or embedded, in the upmixer 102 as will be described in detail later herein with reference to FIGS. 3 and 4.

Figure 2:
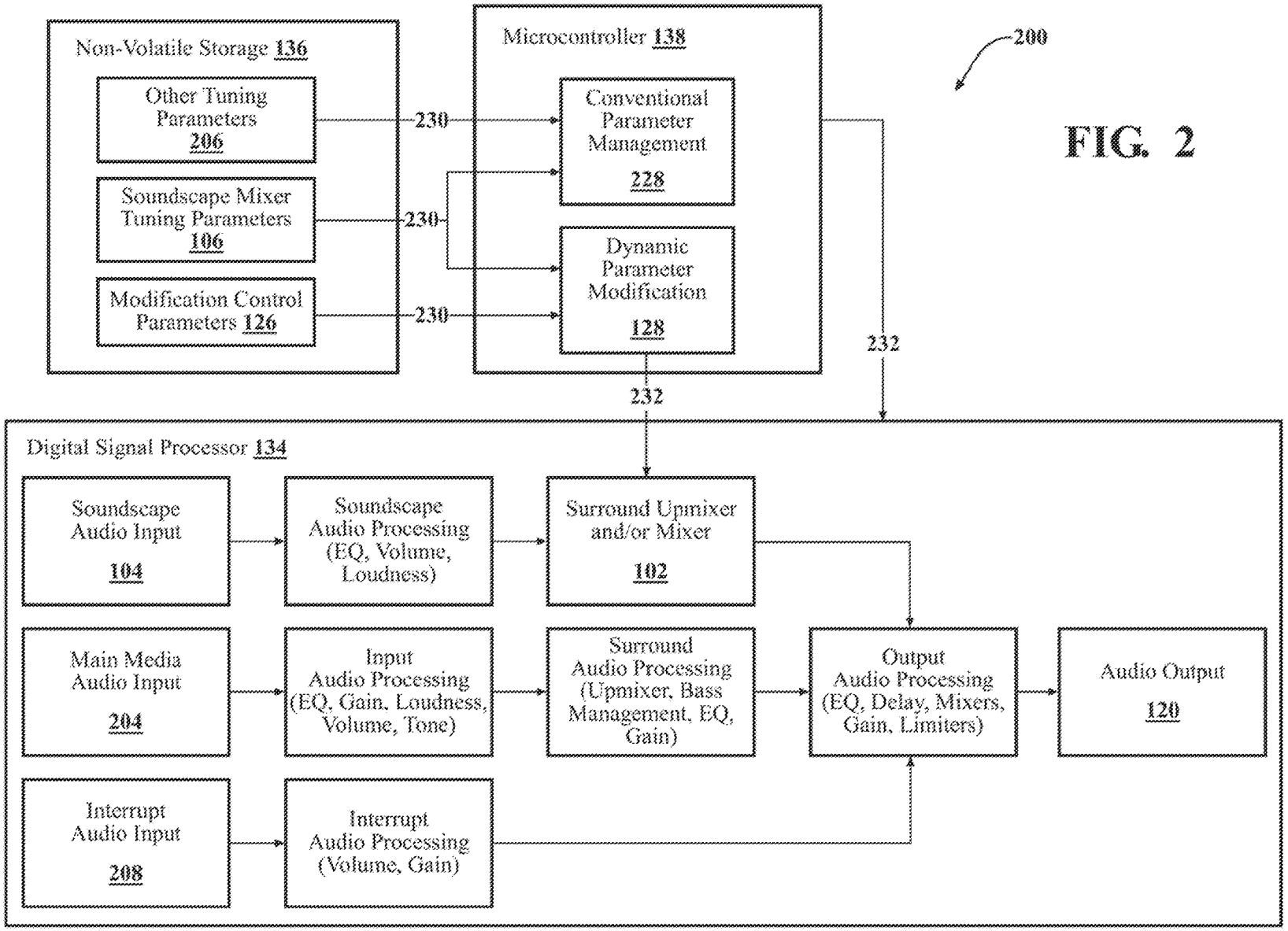
FIG. 2 is a block diagram of an audio processing system.

FIG. 2 is a block diagram of a system 200 that depicts the dynamic parameter modification 128 of the soundscape audio input 104 as it would interact with other, more conventional, audio inputs that might also be played back simultaneously with the soundscape audio. A main media audio input 204 from source that includes, but is not limited to, a radio, DVD, CD, infotainment unit may also be playing in the vehicle. Further, interrupt audio input 208, such as navigation prompts, telephone calls, etc. may also be playing in the vehicle.

Memory, such as non-volatile storage 136 that stores the set of soundscape mixer tuning parameters 106 and the set of modification control parameters 126, may also store other tuning parameters 206 so that they may be accessible, such as by a microcontroller 138, to carry out parameter management and communicate the mixing parameters not only to the upmixer 102 but also to the other audio processing 202, 204, 206 that may be taking place for other audio signals being played back in the vehicle. A conventional parameter management 228 algorithm may read the other tuning parameters 206 from memory 136 and apply them directly to the DSP 134 where they are used in processing audio inputs 204 and 208 to produce their respective audio output 120.

Referring back to FIG. 1, the modification control parameters 126, along with the mixer tuning parameters 106 may be communicated to, or read by, by the dynamic parameter modification 128 by way of an inter-device communication bus 130, such as a serial peripheral interface (SPI) device. The example in FIG. 1 also shows dynamic parameter modification being carried out in microcontroller 138 and that the modified parameters are communicated 132 to the surround upmixer 102. The dynamic parameter modifications 128 are communicated to the surround upmixer 102 during runtime, forcing new settings into the upmixer 102. The communication 132 may also be by way of SPI. Similarly, in FIG. 2, the inter-device communication bus 230 and 232 may be used to communicate the sets of mixer tuning parameters 106, 126, and 206 as they are read by the conventional parameter management algorithm 228 and the dynamic parameter modification algorithm 128 via 230 and communicated to the DSP 134 is 232.

In FIG. 1 and FIG. 2 the dynamic parameter modification algorithm is shown to reside in the microcontroller 138. However, the parameter modification algorithm 128 may also be part of the DSP 134 itself, or it may be integrated, or embedded, into the upmixer 102.

Figure 3:
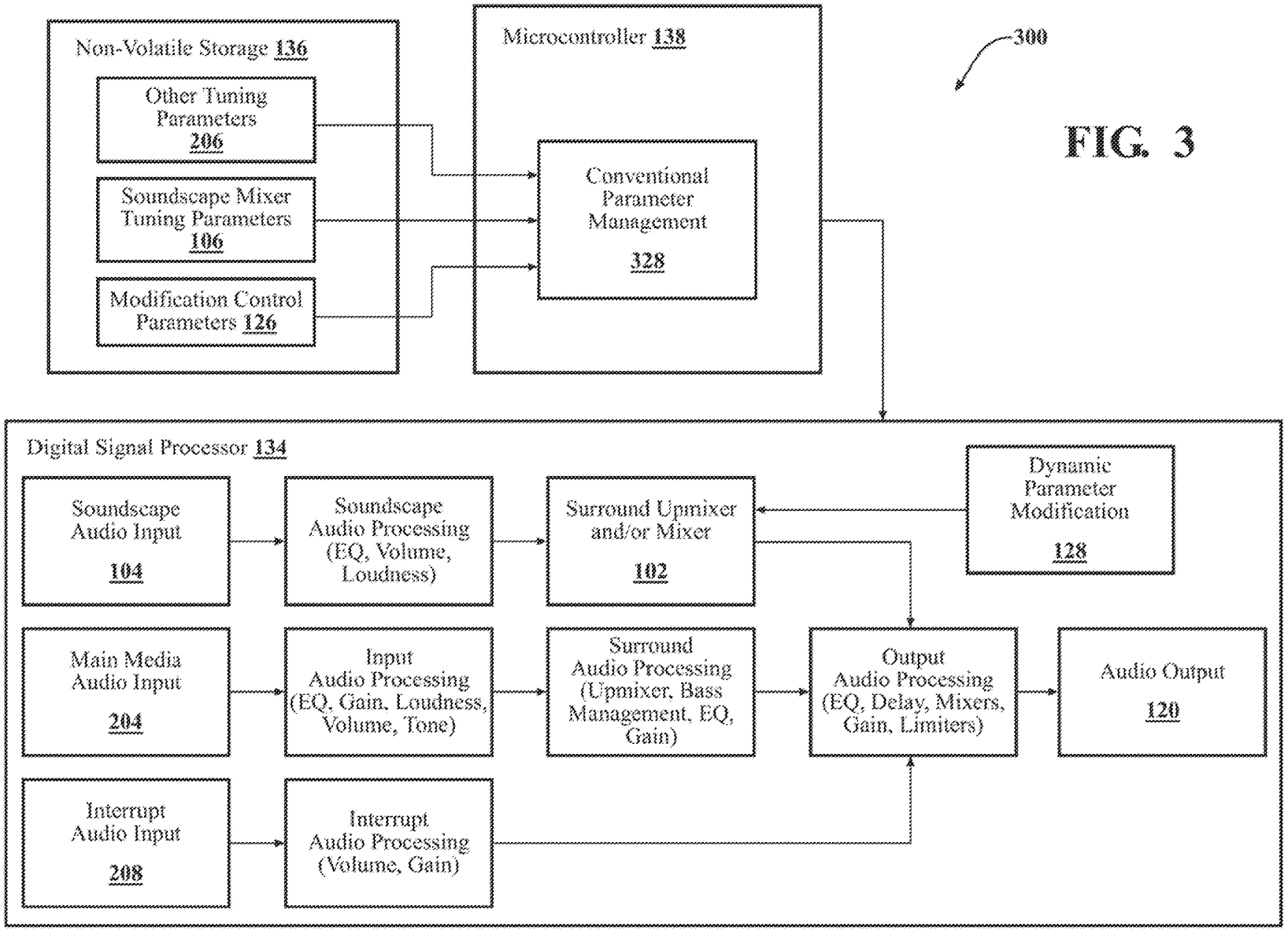
FIG. 3 is a block diagram of an audio processing system.

FIG. 3 is a block diagram of a system 300 where the fixed mixer tuning parameters 106, the modification control parameters 126 and any other tuning parameters 206 may be read from memory 136 to a conventional parameter management algorithm 328 that may be carried out by the microcontroller 138. The conventional parameter management algorithm 328 communicates the sets of mixer and other tuning parameters 106, 206 and modification control parameters 126 to the DSP 134. The dynamic parameter modification algorithm 128 applies the tuning parameters and the modification control parameters within the DSP 134 and communicates the dynamically modified parameters directly to the surround upmixer 102 to be applied to the soundscape audio input 104. All other tuning parameters may be applied as determined by the conventional parameter management algorithm 328 to be processed simultaneously with any other audio (main media audio input 204 and interrupt audio input 208) that is also being played back.

Figure 4:
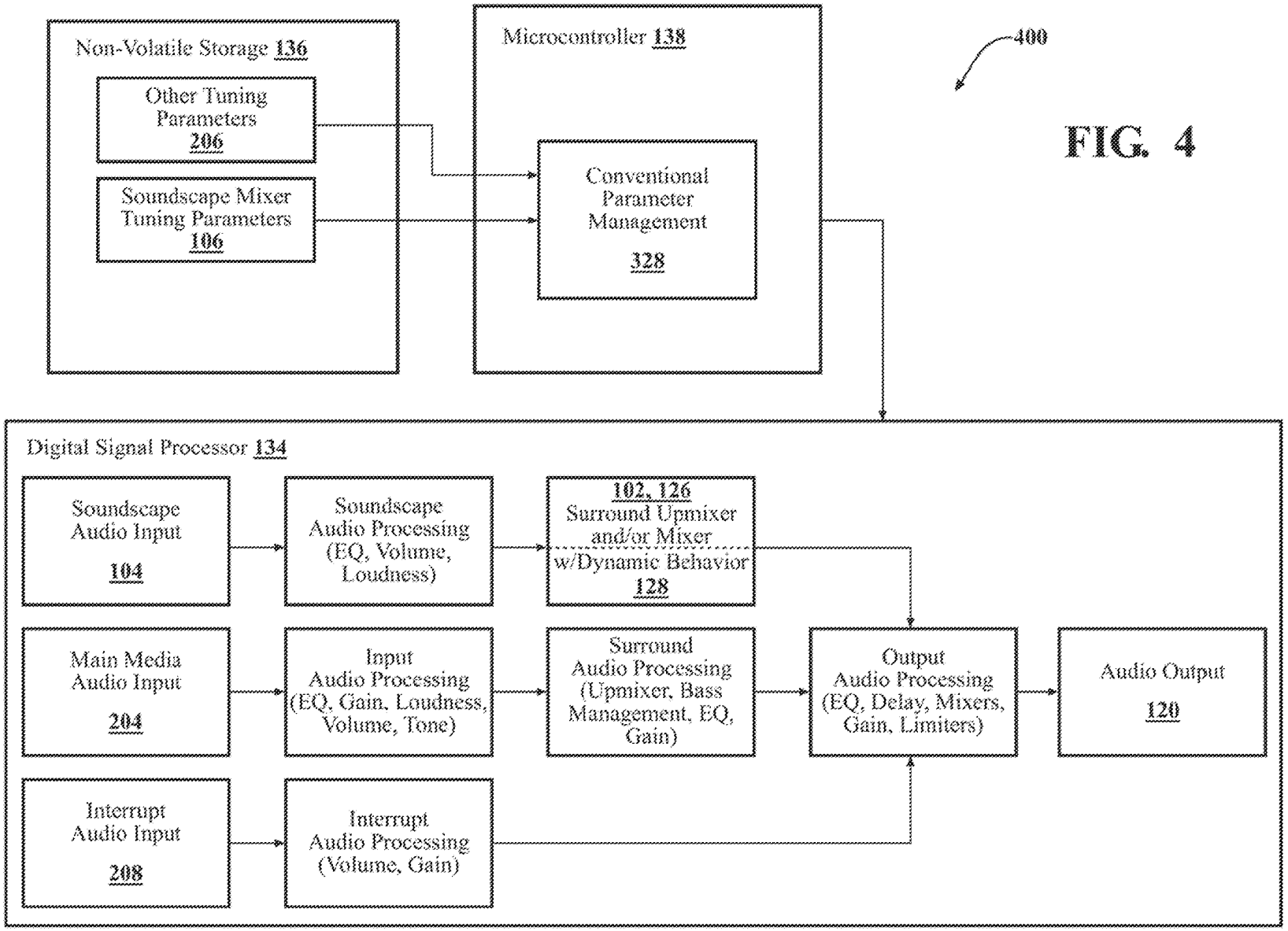
FIG. 4 is a block diagram of an audio processing system.

FIG. 4 is a block diagram of a system 400 that integrates the surround upmixer 102 and the dynamic parameter modification algorithm 128. Upmixer 102 may be equipped with the capability to include the modification control parameters 126, receive the soundscape mixer tuning parameters 106 and carry out the dynamic parameter modifications 128.

In any of the examples shown in FIGS. 1-4, the static soundscape mixer tuning parameters 106 are dynamically modified by the dynamic parameter modification algorithm 128 so that the surround upmixer 102 allows for seamless parameter updates to avoid possible distortions that may be caused by unexpected updates. In some instances, tuning updates may be synchronized to real-time processing aspects of the upmixer 102.

In the methods 500, 600 described hereinafter, the system of FIG. 1 is being directly referenced. However, one skilled in the art is capable of understanding modifications that may be needed to the method steps in order to accommodate any one of the systems shown in FIGS. 2-4 as well. For example, there may be slight variances in the language referring to fetching/reading/writing/communicating as applied to the steps described when the dynamic parameter modification is being carried out in the microcontroller as opposed to the DSP or integrated into the upmixer itself.

Figure 5:
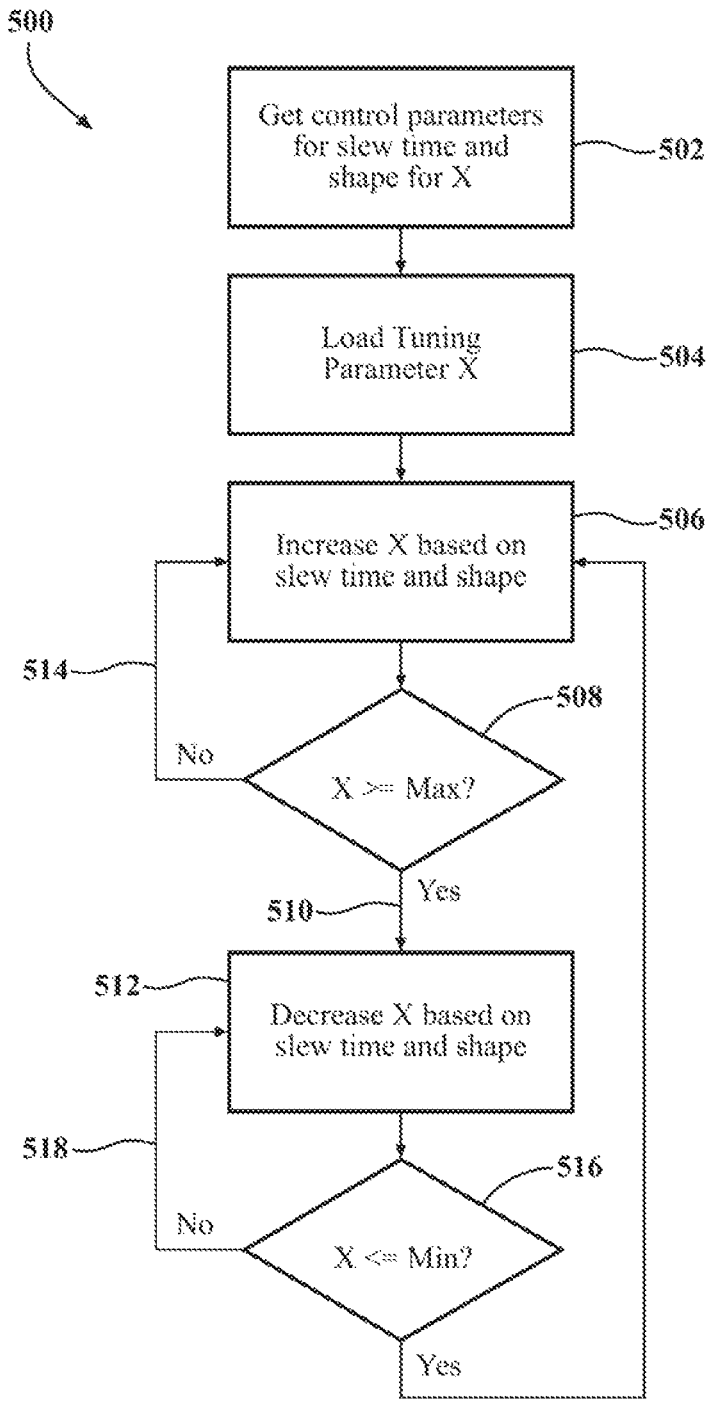
FIG. 5 is a flowchart of a method for updating a set of tuning parameters.

FIG. 5 is a flowchart describing a method 500 for the dynamic parameter modification of at least one parameter in a set of mixer tuning parameters. In the following description, the parameter to be modified in the set of mixer tuning parameters is X. The method 500 fetches 502 mixer tuning parameters 106 (shown in FIGS. 1-4) and modification control parameters 126 (shown in FIGS. 1-4). The mixer tuning define a slew time and shape for one or more parameters, such as X. The mixer tuning parameters are typically found in a tuning file that may be stored in RAM when the audio system is active. The tuning file may also be stored in non-volatile memory. The modification control parameters define maximum and minimum ranges for modification for one or more parameters such as X. The modification control parameters may also be found in a tuning file that may be stored in RAM when the audio system is active, or stored in non-volatile memory.

In this example, mixer tuning parameters and modification control parameters for tuning parameter X are fetched 502 and loaded 504 to the dynamic parameter modification algorithm 128 (shown in FIGS. 1-4). In the dynamic parameter modification algorithm, X is increased 506, based on the mixer tuning parameters such as slew time and shape, and the modification control parameters, to modify the processing of the audio input signal in a manner that simulates natural spatial variations in stereo audio. A check is performed 508 to make sure that the modifications to parameter X remain within a practical, usable range of a predetermined maximum value and a predetermined minimum value. In the event X is greater than or equal to the predetermined maximum setting 510, X is decreased. The decrease 512 is also based on the tuning parameters, such as the defined slew time and shape, for parameter X. In the event X is less than the predetermined maximum setting 514, X is again increased 506 based on the tuning parameters, defined slew time and shape for this example.

When X is decreased 512, another check 516 is performed. In the event X is less than or equal to the minimum setting, X is increased 506 based on the defined slew time and shape. In the event X is greater than the minimum setting 518, X is decreased 512 based on the defined slew time and shape.

The dynamically modified tuning parameters are communicated to the mixer where they are used to transform the audio input to the audio output signal. While this method describes simple parameter updates, not all updates need to be simple incremental changes back and forth within a fixed predetermined range. The predetermined range may be modifiable based on variables in the audio system that are external to the mixer tuning parameters and/or modification control parameters. For example, the changes to X may be made based on a range that is determined from a live condition such as from processing state information and may change based on the current level setting of the live condition, which may be measured or detected by the audio system and therefore known to the digital signal processor and capable of being communicated to the dynamic parameter modification algorithm. Further, new tuning parameters may be loaded at any time. An error handling strategy may also be employed.

Figure 6:
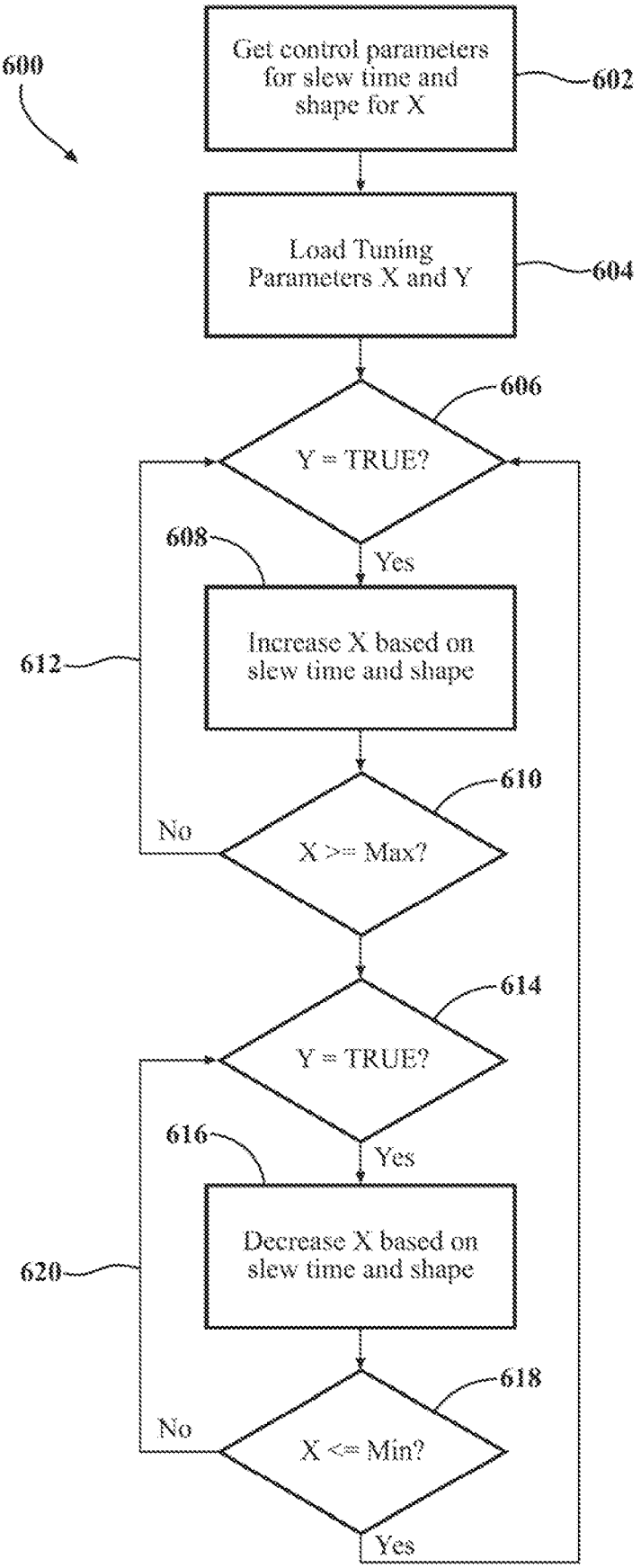
FIG. 6 is a flowchart of a method for updating a set of tuning parameters.

It is also possible to coordinate sets of tuning parameters. For instance, a decision to update parameter X may be based on a state of parameter Y, as shown in FIG. 6. The method 600 fetches 602 tuning parameters for X. Again, examples of the mixer tuning parameters may include but are not limited to, defining minimum and/or maximum ranges for modification, a speed of any modification, a slew time and shape for one or more parameters, such as X, that depend on or are limited by that state of one or more parameters, such as parameter Y meeting a particular condition, such as being in a True or False state, 606. And in this example, tuning parameters X and Y are loaded 604 to the dynamic parameter modification algorithm. For situations in which parameter Y is found to be true 606, X may be increased 608, based on the tuning parameters, such as slew time and shape. A check is performed 610 to make sure that the modifications to parameter X remain within a practical, usable range. In the event X is less than the predetermined maximum value 612, the method will attain check 606 to verify that parameter Y remains true, and again increase X 608. In the event the step of performing a check 610 results in X being found to be greater than or equal to a predetermined maximum setting, the state of Y is again checked 614. If Y remains True, X is decreased 616 based on the defined slew time and shape for parameter X.

Upon a decrease in X, X is checked 618 again to make sure that X is within an acceptable range between the predetermined maximum and the predetermined minimum value. When X is found to be greater than the predetermined minimum 620, the check 614 for the state of parameter Y is repeated 614. And, if X remains within range, X may be decreased 616 again.

When X is found to be less or equal to a predetermined minimum setting 618, the state of Y is checked 606, and verified if Y remains True, X may again increase 608 based on the defined slew time and shape. The dynamically modified tuning parameters are communicated to the upmixer where they are applied to transform the audio input to the audio output signal. While this method describes simple parameter updates, not all updates need to be simple incremental changes back and forth within a predetermined range.

Alternatively, Y may be a variable that is external to the control parameters, for example processing state information, which may be used to modify the predetermined range for X. The processing state information may, for example, be an external variable such as a volume level of the audio system. When the volume level or setting is low, the predetermined range for X may be larger than when the volume level or setting is high. New tuning parameters may be loaded at any time. An error handling strategy may also be employed.

In the foregoing specification, the present disclosure has been described with reference to specific exemplary embodiments. Various modifications and changes may be made, however, without departing from the scope of the present disclosure as set forth in the claims. For example, the present disclosure may be combined with object-based upmixers. When an object is placed in an acoustic space, the spatial properties of the object may be made to change over time in terms of location, size and vector. The specification and figures are illustrative, rather than restrictive, and modifications are intended to be included within the scope of the present disclosure. Accordingly, the scope of the present disclosure should be determined by the claims and their legal equivalents rather than by merely the examples described.

Also, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims. For example, the dynamic parameter modification may be carried out by the microprocessor, the DSP, or internally in the surround upmixer.

Benefits, other advantages and solutions to problems have been described above with regard to particular embodiments; however, any benefit, advantage, solution to problem or any element that may cause any particular benefit, advantage or solution to occur or to become more pronounced is not to be construed as critical, required or essential features or components of any or all the claims.

The terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present disclosure, in addition to those not specifically recited, may be varied or otherwise particularly adapted to specific environments, manufacturing specifications, design parameters or other operating requirements without departing from the general principles of the same.

The invention claimed is:

1. A system for creating natural spatial variations in an audio output, comprising:

an audio input signal having fixed spatial variations;

an audio signal processor that receives the audio input signal, the audio signal processor is configured to dynamically determine a modification for at least one parameter in a set of mixer tuning parameters based on a state of at least one other parameter, and dynamically modify the at least one parameter in the set of mixer tuning parameters over time and within a predetermined range, the audio signal processor defines a predetermined minimum and a predetermined maximum for at least one of a range for modification, a speed for modification, and a slew time and shape for the at least one parameter being dynamically determined and modified based on the state of the at least one other parameter; and an upmixer applying the set of mixer tuning parameters to increase or decrease the at least one parameter in the set of mixer tuning parameters within the predetermined minimum and predetermined maximum and based on the state of the at least one other parameter to transform the audio input signal having fixed spatial variations into an audio output having natural spatial variations in the audio output.

2. The system of claim 1 wherein the at least one parameter is modified in real time.

3. The system of claim 1 wherein the at least one parameter in the set of mixer tuning parameters is modified over time and within a predetermined range by a dynamic parameter modification algorithm that also applies a set of modification control parameters.

4. The system of claim 3 wherein the dynamic parameter modification algorithm communicates the at least one dynamically modified parameter to a mixer.

5. The system of claim 4 wherein the mixer is a surround upmixer.

6. The system of claim 3 further comprises:

a conventional parameter management algorithm that communicates the set of mixer tuning parameters and the modification control parameters to the audio signal processor; and the dynamic parameter modification algorithm is carried out in the audio signal processor directly by the mixer.

7. The system of claim 1 wherein the predetermined range is based on at least one variable that is external to the set of mixer tuning parameters, the predetermined range may be modified based on a current setting of the at least one external variable.

8. The system of claim 7 wherein the external variable is a current setting in an audio system that is detected or measured at the audio signal processor.

9. An audio processing system for creating natural spatial variations in an audio output, comprising:

a soundscape audio input having fixed spatial variations;

a set of mixer tuning parameters;

a set of modification control parameters being determined in real time for at least one parameter in the set of mixer tuning parameters based on a state of at least one other parameter;

a dynamic parameter modification algorithm that dynamically modifies the at least one parameter in the set of mixer tuning parameters over time and within a predetermined range defined by applying the set of modification control parameters based on the state of the at least one other parameter;

an audio signal processor dynamically modifies at least one parameter in the set of mixer tuning parameters by defining a predetermined minimum and a predetermined maximum for at least one of a range for modification, a speed for modification, and a slew time and shape for the at least one parameter being dynamically modified; and a surround upmixer that receives the soundscape audio input having fixed spatial variations and the set of mixer tuning parameters that includes the at least one dynamically modified parameter, the at least one dynamically modified parameter in the set of mixer tuning parameters causes the surround upmixer to apply the set of mixer tuning parameters to increase or decrease the at least one parameter in the set of mixer tuning parameters within the predetermined minimum and predetermined maximum and based on the state of the at least one other parameter to transform the audio input signal having fixed spatial variations into an audio output signal having natural spatial variations.

10. The system of claim 9 wherein the dynamic parameter modification algorithm is further configured to:

increase the at least one parameter incrementally until a predetermined maximum value for the at least one parameter is met; and decrease the at least one parameter incrementally until a predetermined minimum value for the at least one parameter is met.

11. The system of claim 10 wherein the predetermined maximum value and the predetermined minimum value for the at least one parameter is defined by the set of modification control parameters.

12. The system of claim 9 wherein the predetermined range is further defined by at least one variable that is external to the set of modification control parameters.

13. A method for creating natural spatial variations in an audio output, the method comprising the steps of:

receiving, at an audio signal processor, an audio input signal having fixed spatial variations;

dynamically determining a modification for, and dynamically modifying, at least one parameter in a set of mixer tuning parameters over time and within a predetermined range defined by a set of modification control parameters and based on a state of at least one other parameter, the audio signal processor dynamically modifies at least one parameter in the set of tuning parameters by defining a predetermined minimum and a predetermined maximum of at least one of a range for modification, a speed for modification, and a slew time and shape for the at least one parameter being dynamically modified;

applying the set of mixer tuning parameters that includes the at least one dynamically determined and modified parameter to increase or decrease the at least one dynamically modified parameter in the set of mixer tuning parameters, within the predetermined minimum and predetermined maximum, and based on the state of the at least one other parameter to create natural spatial variations in the audio output; and playing the audio output having natural spatial variations at one or more loudspeakers.

14. The method of claim 13 wherein the step of dynamically modifying at least one parameter further comprises dynamically modifying the at least one parameter in real time.

15. The method of claim 13 wherein the set of dynamically modifying at least one parameter further comprises:

increasing the at least one parameter incrementally until a predetermined maximum value for the at least one parameter is met; and decreasing the at least one parameter incrementally until a predetermined minimum value for the at least one parameter is met.

16. The method of claim 15 further comprising the steps of:

increasing the at least one parameter based on a current state of at least one other parameter in the set of mixer tuning parameters; and decreasing the at least one parameter based on the current state of at least one other parameter in the set of mixer tuning parameters.

17. The method of claim 16 further comprising the steps of:

checking the state of the at least one other parameter in the set of mixer tuning parameters prior to increasing the at least one parameter; and checking the state of the at least one other parameter in the set of mixer tuning parameters prior to decreasing the at least one parameter.

18. The method of claim 13 wherein the step of dynamically modifying at least one parameter in a set of mixer tuning parameters over time and within a predetermined range defined by a set of modification control parameters further comprises the predetermined range being modifiable by at least one variable that is external to the set of mixer tuning parameters.

* * * * *